US011648171B2

(12) United States Patent
Moore et al.

(10) Patent No.: US 11,648,171 B2
(45) Date of Patent: May 16, 2023

(54) MOBILITY DEVICES WITH TRANSITIONAL FOOT PLATES

(71) Applicants: TOYOTA MOTOR NORTH AMERICA, INC., Plano, TX (US); INSTITUTE FOR CREATIVE INTEGRATION, Oakland, CA (US)

(72) Inventors: Douglas A. Moore, Fairview, CA (US); Paul Nichols, Healdsburg, CA (US); Thomas Mitchell Dair, Lafayette, CA (US)

(73) Assignees: Toyota Motor North America, Inc., Plano, TX (US); Institute for Creative Integration, Oakland, CA (US)

( * ) Notice: Subject to any disclaimer, the term of this patent is extended or adjusted under 35 U.S.C. 154(b) by 219 days.

(21) Appl. No.: 17/014,233

(22) Filed: Sep. 8, 2020

(65) Prior Publication Data

US 2022/0071834 A1 Mar. 10, 2022

(51) Int. Cl.
*A61H 3/04* (2006.01)
*A61G 5/12* (2006.01)

(52) U.S. Cl.
CPC ..... *A61H 3/04* (2013.01); *A61G 5/128* (2016.11); *A61H 2003/043* (2013.01);
(Continued)

(58) Field of Classification Search
CPC ..... A61H 3/04; A61G 5/128
See application file for complete search history.

(56) References Cited

U.S. PATENT DOCUMENTS 2,556,121 A * 6/1951 Thomas ..... A61G 5/10 482/68
3,107,105 A * 10/1963 Heriford ..... A61G 5/026 280/211

(Continued)

FOREIGN PATENT DOCUMENTS

CN 107260419 A 10/2017
IN 201821012352 A 10/2019
JP 5312550 B2 10/2013

OTHER PUBLICATIONS

Probasics transport rollator walker with seat and wheels—folding walker and transport chair, (https://www.amazon.com/ProBasics-Transport-Rollator-Walker-Wheels/dp/B00MW07ZRC), accessed Jul. 6, 2020, 2 pages.

(Continued)

*Primary Examiner* — David R Dunn
*Assistant Examiner* — Danielle Jackson
(74) *Attorney, Agent, or Firm* — Dinsmore & Shohl LLP

(57) ABSTRACT

A mobility device positionable between a powered transport position and a powered wheelchair position is provided. The mobility device includes a frame including a pair of side rails, a pair of wheels on each side rail, a distance between each wheel on a corresponding side rail defining a length of the mobility device, a pair of arms coupled to an end of the pair of side rails, and a seat member positioned between the pair of arms. A pair of foot plates is pivotally attached to the pair of side rails and rotatable between an unfolded position in which the foot plate is horizontal and a folded position in which the foot plate is vertical. Each foot plate having a length at least substantially equal to the length of the mobility device.

19 Claims, 5 Drawing Sheets

(52) U.S. Cl.
CPC ..... *A61H 2201/0149* (2013.01); *A61H 2201/0173* (2013.01); *A61H 2201/1635* (2013.01); *A61H 2201/1642* (2013.01)

(56) References Cited

U.S. PATENT DOCUMENTS

| | | | | |
|---|---|---|---|---|
| 4,029,311 | A * | 6/1977 | Chanslor | A61H 3/04 188/29 |
| 5,411,044 | A * | 5/1995 | Andolfi | A61G 7/1019 414/921 |
| 5,419,571 | A | 5/1995 | Vaughan | |
| 6,338,493 | B1 | 1/2002 | Wohlgemuth et al. | |
| 6,378,883 | B1 | 4/2002 | Epstein | |
| 7,921,953 | B2 * | 4/2011 | Irvine | A61H 3/04 297/423.12 |
| 8,078,365 | B2 * | 12/2011 | Emilsson | A61G 5/12 180/907 |
| 8,172,023 | B1 * | 5/2012 | Irvine | A61H 3/008 297/423.12 |
| 8,522,907 | B1 * | 9/2013 | Irvine | A61G 5/14 297/423.12 |
| 8,544,486 | B1 * | 10/2013 | Hardwick | A61H 3/04 135/77 |
| 9,649,236 | B1 | 5/2017 | Wike et al. | |
| 9,854,203 | B2 | 12/2017 | Benetti et al. | |
| 10,016,324 | B1 * | 7/2018 | Howard | A61H 3/00 |
| 10,166,165 | B1 * | 1/2019 | McGuire | A45B 3/00 |
| 10,342,721 | B2 * | 7/2019 | Itano | A61G 5/128 |
| 2007/0199586 | A1 * | 8/2007 | Cheng | A61H 3/04 280/87.021 |
| 2007/0283990 | A1 | 12/2007 | Fernandez et al. | |
| 2013/0140781 | A1 * | 6/2013 | Prather | A61H 3/04 280/47.38 |
| 2020/0008990 | A1 | 1/2020 | Harrison | |
| 2022/0062077 | A1 * | 3/2022 | Moore | B62D 51/04 |
| 2022/0144328 | A1 * | 5/2022 | Moore | B62B 3/02 |
| 2022/0144329 | A1 * | 5/2022 | Moore | B62B 5/002 |
| 2022/0151845 | A1 * | 5/2022 | Moore | A61G 5/127 |
| 2022/0151846 | A1 * | 5/2022 | Moore | A61G 5/04 |

OTHER PUBLICATIONS

"Flip" combination rollator (https://hpurehab.com/flip-combination-rollator.html), accessed Jul. 6, 2020, 5 pages.

* cited by examiner

MOBILITY DEVICES WITH TRANSITIONAL FOOT PLATES

TECHNICAL FIELD

The present specification generally relates to mobility devices for transporting a person and/or cargo and, more specifically, mobility devices having transitional foot plates to permit the mobility devices to be used as a walker.

BACKGROUND

Mobility devices such as, for example, scooters, walkers, wheelchairs, cargo transport devices, and the like, may be manually operated and/or powered. When manually operated, the mobility device is operated under a user's own force. For instance, the user may push the mobility device to transport cargo or use as a walker. When the mobility device is used as a wheelchair, the user may manually rotate the wheels of the mobility device to maneuver the mobility device. Further, these mobility devices may be powered to assist in transporting a user and/or cargo. As such, powered mobility devices may permit operation by both manual and powered operation to accommodate the different uses.

When these mobility devices are powered, at least one foot plate or platform may be provided for supporting a user or cargo when operating the mobility device as a scooter or cargo transport device. However, these foot plates or platforms typically prevent the user from manually operating the mobility device as a walker by being in the way of the user walking between side rails of the mobility device. Thus, the foot plates or platform must be moved out of the way to permit the user to walk between the mobility device. Further, these foot plates or platforms, even when utilized on a wheelchair, are typically sized to accommodate a person's feet to avoid taking up excess space and adding to the overall weight of the mobility device. As a result, the user is restricted to the location in which he or she can place his or her feet, as well as the size and amount of cargo that may be transported when the mobility device is used as a cargo transport device.

SUMMARY

In one embodiment, a mobility device is positionable between a powered transport position and a powered wheelchair position. The mobility device includes a frame including a pair of side rails having a first end and an opposite second end, a wheel provided proximate the first end and the second end of each of the pair of side rails, a distance between each wheel on a corresponding one of the pair of side rails defining a length of the mobility device, a pair of arms coupled to the first end of the pair of side rails, and a seat member positioned between the pair of arms. The mobility device further includes a pair of foot plates pivotally attached to the pair of side rails, each foot plate rotatable between an unfolded position in which the foot plate is horizontal and a folded position in which the foot plate is vertical, each foot plate has a length at least substantially equal to the length of the mobility device.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Embodiments described herein are directed to powered mobility devices that include foot plates pivotally attached to a frame and transitionable between an unfolded position for supporting a user and/or cargo thereon, and a folded position for allowing a user to walk between the frame of the mobility device and to be used as a walker.

The mobility device is positionable between a powered transport position and a powered wheelchair position. The mobility device generally includes a frame including a pair of side rails having a first end and a second end and a wheel provided proximate the first end and the second end of each side rail. A length of the mobility device is defined by a distance between each wheel on a corresponding side rail. The mobility device further includes a pair of arms extending from the first end of the pair of side rails, a seat member provided between the pair of arms, and a pair of foot plates pivotally attached to the pair of side rails. Each foot plate is rotatable between an unfolded position in which the foot plate is horizontal and a folded position in which the foot plate is vertical. Each foot plate has a length at least substantially equal to the length of the mobility device.

Figure 1:
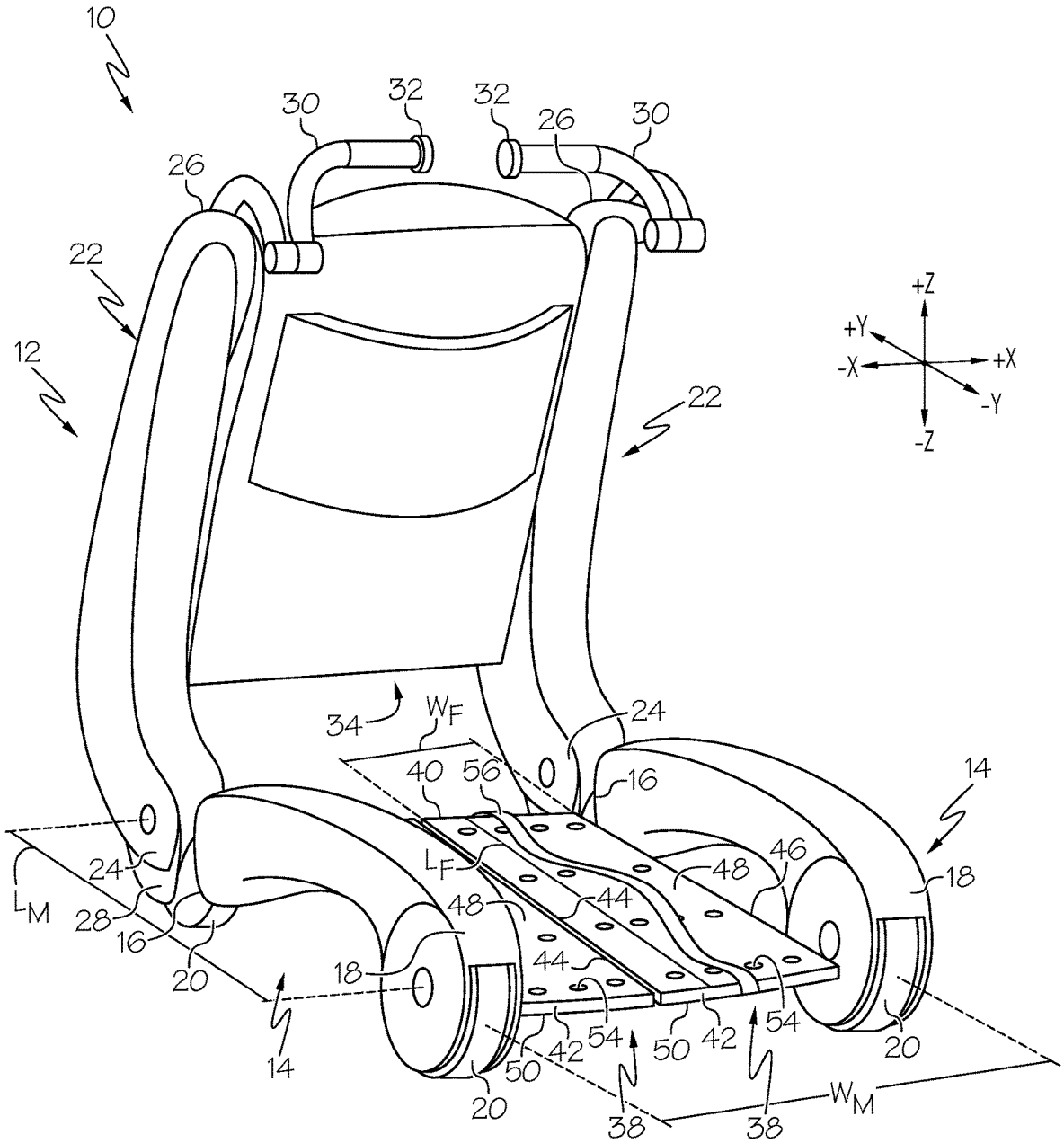
FIG. 1 schematically depicts a mobility device in a transport position and including a pair of foot plates in an unfolded position, according to one or more embodiments shown and described herein.

As used herein, the term "longitudinal direction" refers to the forward-rearward direction of the mobility device (i.e., in the +/−Y direction of the coordinate axes depicted in FIG. 1). The term "lateral direction" refers to the cross direction (i.e., in the +/−X direction of the coordinate axes depicted in FIG. 1), and is transverse to the longitudinal direction. The term "vertical direction" refers to the upward-downward direction of the mobility device (i.e., in the +/−Z direction of the coordinate axes depicted in FIG. 1). As used herein, "upper" and "above" are defined as the positive Z direction of the coordinate axes shown in the drawings. "Lower" and "below" are defined as the negative Z direction of the coordinate axes shown in the drawings.

Various embodiments of the mobility devices and the operation of the mobility devices are described in more detail herein. Whenever possible, the same reference numerals will be used throughout the drawings to refer to the same or like parts.

Figure 2:
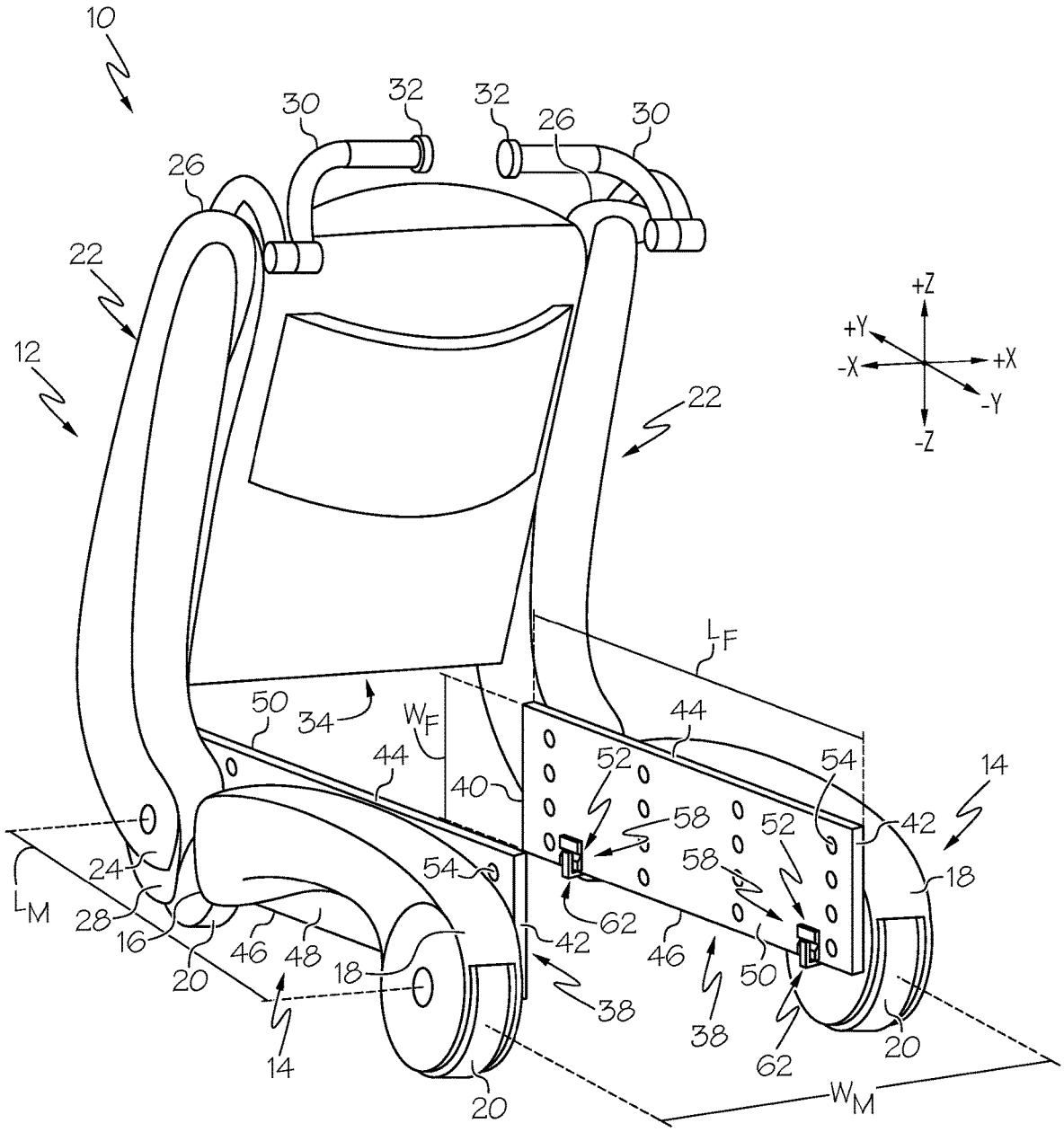
FIG. 2 schematically depicts the mobility device in a walker position with the pair of foot plates in a folded position, according to one or more embodiments shown and described herein.
Figure 3:
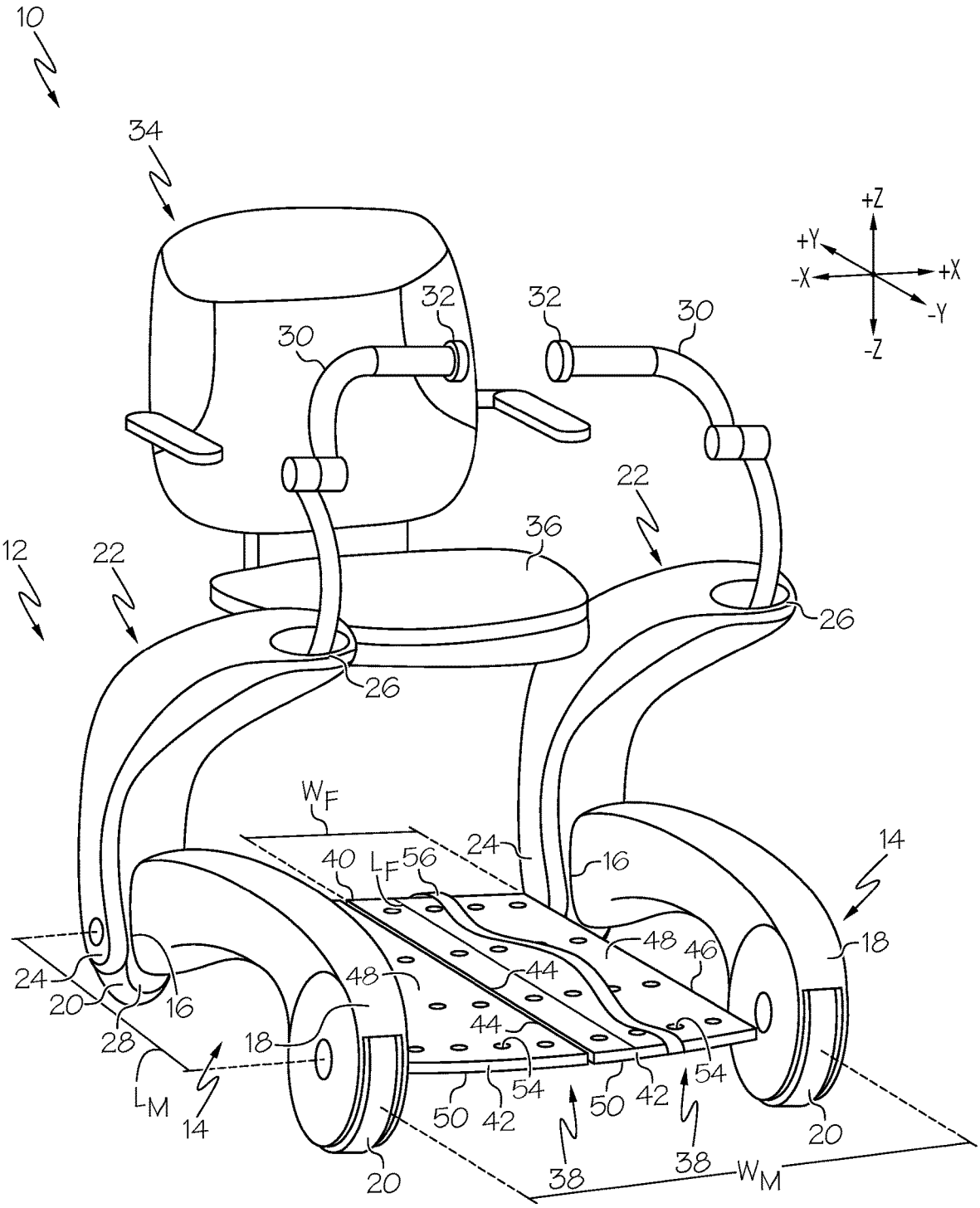
FIG. 3 schematically depicts the mobility device in a wheelchair position with the pair of foot plates in the unfolded position, according to one or more embodiments shown and described herein.

Referring now to FIGS. 1-3, a mobility device 10 is illustrated according to one or more embodiments described herein. The mobility device 10 is positionable in at least a transport position (FIG. 1), to be used as a scooter or cargo transport device, a walker position (FIG. 2), and a wheelchair position (FIG. 3). It should be appreciated that the mobility device 10 may be positionable in other positions, not discussed herein, such as, for example, a storage position. Further, it should be appreciated that the mobility device 10 may be powered, i.e., at least partially self-propelled, by a power source such as, for example, a battery or solar-powered. The power source may facilitate operation of the mobility device 10 including transitioning between the different positions disclosed herein.

With reference to FIG. 1, the mobility device 10 includes a frame 12 including at least one side rail 14. In embodiments, the mobility device 10 may include a pair of side rails 14 with each side rail 14 having a first end 16 and an opposite second end 18. Each side rail 14 may include a pair of wheels 20 with one wheel, i.e., front wheel, provided proximate the first end 16 and another wheel, i.e., rear wheel, provided proximate the second end 18 of the side rail 14. The wheels 20 of the mobility device 10 may be powered many any suitable gears and motors, not discussed in detail herein, for moving the mobility device 10 along a floor surface. The wheels 20 may also may be permitted to be manually operated when the mobility device 10 is pushed to reduce energy consumption. The mobility device 10 has a length $L_M$ defined by a distance between the pair of wheels 20 of a corresponding side rail 14 and extending in the +/−Y direction of the coordinate axes depicted in the drawings. Similarly, the mobility device 10 has a width $W_M$ defined by a distance between opposite rear wheels 20 or opposite front wheels 20 and extending in the +/−X direction of the coordinate axes depicted in the drawings.

The frame 12 further includes an arm 22 extending proximate the first end 16 of each side rail 14. Each arm 22 has a first end 24 and an opposite second end 26. In embodiments, the first end 24 of each arm 22 is rotatably attached to the first end 16 of a corresponding one of the side rails 14 and positionable between at least an upright position, as shown in FIGS. 1 and 2, and an intermediate position, as shown in FIG. 3. In embodiments, the first end 24 of the arm 22 may be rotatably coupled to the first end 16 of the side rail 14 either directly or indirectly by a coupling member 28 allowing the arm 22 to rotate between the upright position and the intermediate position relative to the side rail 14.

Each arm 22 may include a handle portion 30, which may include at least one control member 32 for operating the mobility device 10 such as, for example, powering on or off the mobility device 10, controlling a speed and/or direction of the mobility device 10, and transitioning between operating positions of the mobility device 10. The control member 32 may include at least one switch, button, or the like for controlling the mobility device 10.

Further, as discussed in more detail herein, the frame 12 of the mobility device 10 may include a seat member 34 provided between the pair of arms 22 and rotatable relative to the pair of arms 22. The seat member 34 may be positionable between at least a stowed position, as shown in FIGS. 1 and 2, and a use position, as shown in FIG. 3. When in the use position, the seat member 34 forms a seat having a seat surface 36 extending horizontal for supporting a user when the mobility device 10 is in the wheelchair position.

The mobility device 10 further includes a pair of foot plates 38. Each foot plate 38 is coupled to a corresponding one of the pair of side rails 14 and rotatably attached thereto. Each foot plate 38 has a front end 40, an opposite rear end 42, a first or inner side 44, an opposite second or outer side 46, a first or upper surface 48, and an opposite second or lower surface 50. At least one hinge 52, described in more detail herein, may be provided for rotatably attaching each foot plate 38 to a corresponding side rail 14. As shown in FIG. 2, in embodiments, each foot plate 38 may include a pair of hinges 52, such as a front hinge and a rear hinge, for rotatably attaching the foot plate 38 to a corresponding side rail 14. As such, the foot plates 38 are operable between an unfolded or horizontal position, as shown in FIGS. 1 and 3, and a folded or upright position, as shown in FIG. 2. When the foot plates 38 are in the unfolded position, the upper surface 48 faces an upward direction and the lower surface 50 faces an opposite downward direction. When the foot plates 38 are in the folded position, the upper surface 48 faces a corresponding side rail 14 to which it is rotatably coupled and the lower surface 50 faces away from the corresponding side rail 14 and toward the opposite side rail 14.

In embodiments, a plurality of apertures 54 may be formed in each of the foot plates 38 extending through the upper surface 48 and the lower surface 50 of the foot plates 38 to allow fluid and debris to pass through the foot plates 38. This prevents fluid and debris from collecting on the upper surface 48 of the foot plates 38. In embodiments, as shown in FIG. 1, each foot plate 38 may include a restraint member 56 such as, for example, a strap, buckle, or the like for securing an object or cargo to the upper surface 48 of the foot plates 38. The restraint member 56 may be detachably connected to the foot plates 38, extend from any suitable location of the foot plates 38, and have an adjustable length. In other embodiments, the restraint member 56 may extend from the side rails 14 as opposed to the foot plates 38 themselves. In embodiments, each foot plate 38 includes a one-piece, monolithic structure extending from the front end 40, the rear end 42, the inner side 44, and the outer side 46.

Each foot plate 38 has a length $L_F$ defined by a distance between the front end 40 and the rear end 42 of the foot plate 38 and extending in the +/−Y direction of the coordinate axes depicted in the drawings. Similarly, each foot plate 38 has a width $W_F$ defined by a distance between the inner side 44 and the outer side 46 and extending in the +/−X direction of the coordinate axes depicted in the drawings. As shown, the length $L_F$ of the foot plates 38 is at least substantially equal to the length $L_M$ of the mobility device 10. As used herein, the term "substantially" is understood to mean more than 50%. As such, in embodiments, the length $L_F$ of the foot plates 38 is more than 50% of the length $L_M$ of the mobility device 10. In embodiments, the length $L_F$ of the foot plates 38 is at least 75% of the length $L_M$ of the mobility device 10. In embodiments, the length $L_F$ of the foot plates 38 is at least 90% of the length $L_M$ of the mobility device 10. In embodiments, the length $L_F$ of the foot plates 38 is greater than the length $L_M$ of the mobility device 10. By providing the foot plates 38 having a length $L_F$ that is at least substantially as long as the length $L_M$ of the mobility device 10, a user or cargo being supported on the foot plates 38 may be permitted to be positioned along a greater portion of the length $L_M$ of the mobility device 10 than would otherwise be provided by typical, commercial supports.

Referring now to FIG. 1, when the foot plates 38 are in the unfolded position, the total width $W_{FT}$ of the foot plates 38, which is the sum of the width $W_F$ of both foot plates 38, is substantially equal to the width $W_M$ of the mobility device 10. In embodiments, the total width $W_{FT}$ of the foot plates 38 is more than 50% of the width $W_M$ of the mobility device 10. In embodiments, the total width $W_{FT}$ of the foot plates 38 is at least 75% of the width of the mobility device. In embodiments, the total width $W_{FT}$ of the foot plates is at least 90% of the width of the mobility device. By providing the pair of foot plates having a total width $W_{FT}$ substantially equal to the width $W_M$ of the mobility device 10, the risk of a person stepping between the inner side 44 of each foot plate 38, or cargo falling between the inner side 44 of each foot plate 38, is reduced or substantially eliminated.

When in the unfolded position, the foot plates 38 are configured to support a user and/or cargo being transported. Thus, in embodiments, the foot plates 38 are configured to support at least 100 pounds. In embodiments, when in the unfolded position, the foot plates 38 are configured to support at least 200 pounds. In embodiments, when in the unfolded position, the foot plates 38 are configured to support at least 300 pounds.

As described in more detail herein, each foot plate 38 may be manually operated to position the foot plates 38 between the unfolded position and the folded position. However, in embodiments, the foot plates 38 may include any suitable powered mechanism such as, for example, a motor or actuator, for automatically positioning the foot plates 38 between the unfolded position and the folded position. When the foot plates 38 are powered, the foot plates 38 may be operated by utilizing the control member 32 on the handle portion 30 each arm 22.

Referring now to FIG. 3, the mobility device 10 is shown in the wheelchair position. When in the wheelchair position, the arms 22 are rotated in a rearward direction toward the second end 18 of the side rails 14 and the seat member 34 is rotated to form a seat on which a user may seated. When in the wheelchair position, it should be appreciated that the foot plates 38 extend below the seat member 34 such that the foot plates 38 overlap the seat member 34, specifically the seat surface 36, in the +/−Z direction of the coordinate axes depicted in the drawings. The foot plates 38 may be used for supporting the feet of a user seated in the mobility device 10 and further support cargo positioned on the foot plates 38 under the seat member 34. This differs from conventional wheelchairs having foot supports, which do not extend under a seat of the wheelchair.

Figure 4:
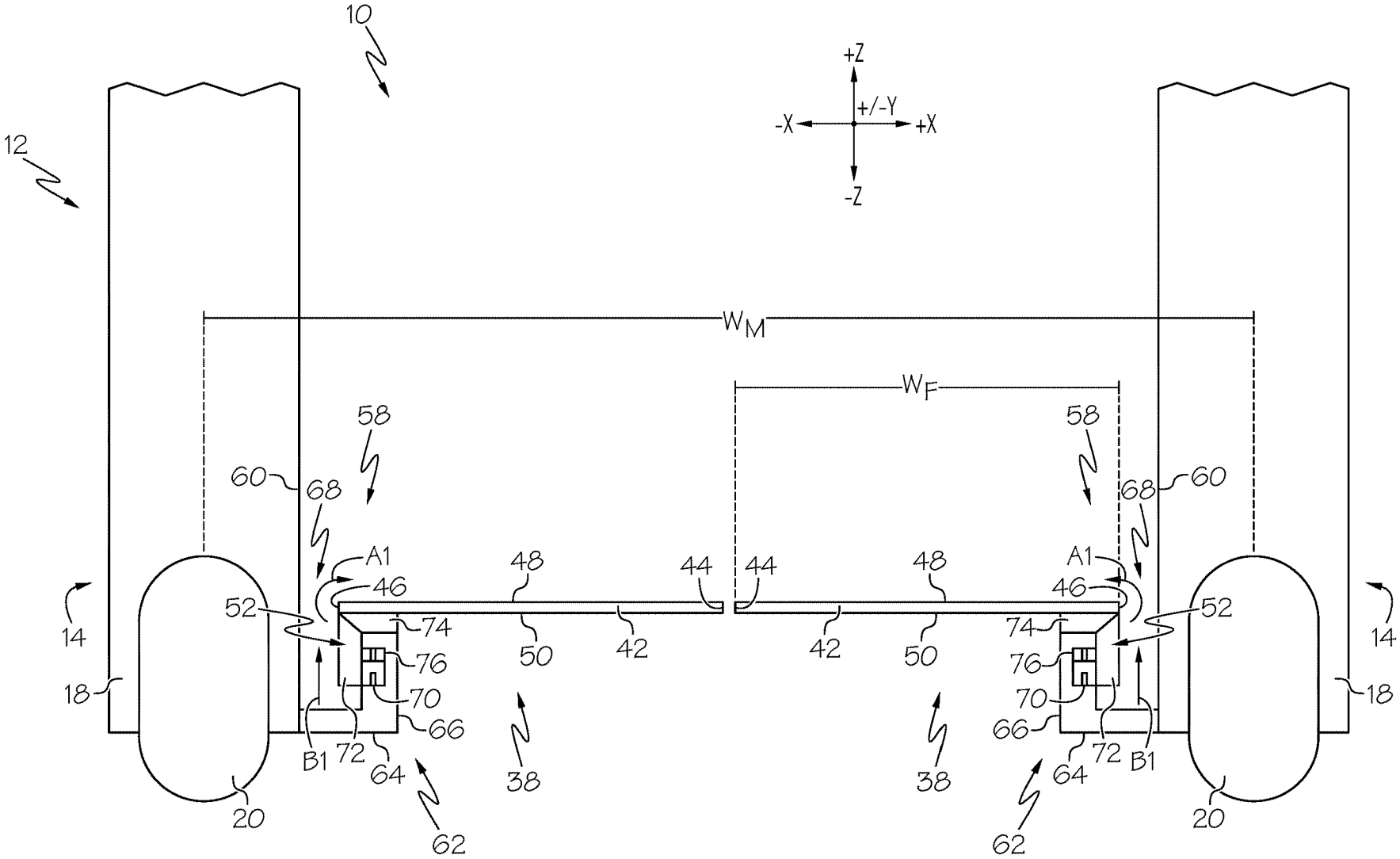
FIG. 4 schematically depicts a partial rear view of the mobility device with the pair of foot plates in the unfolded position, according to one or more embodiments shown and described herein.
Figure 5:
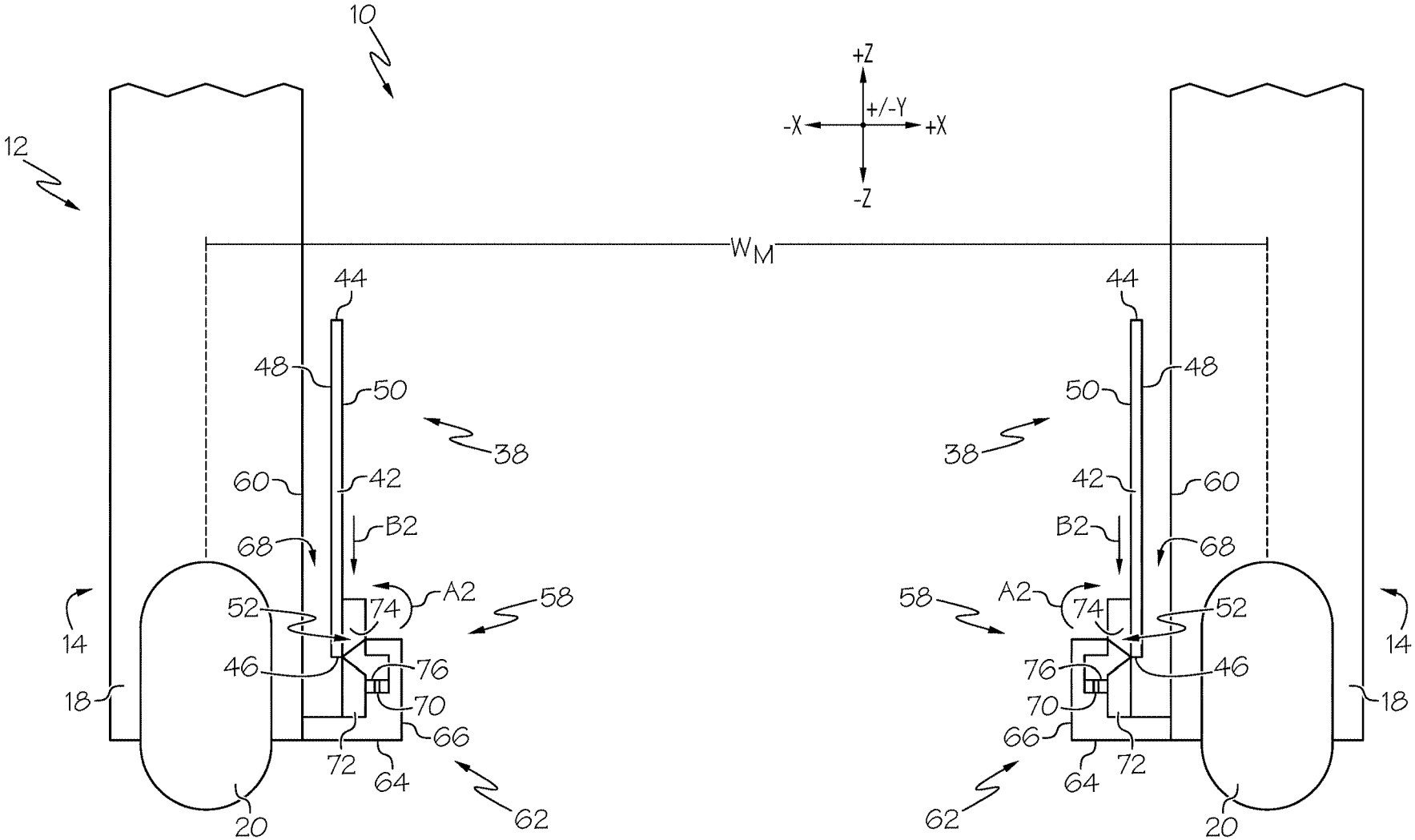
FIG. 5 schematically depicts a partial rear view of the mobility device with the pair of foot plates in the folded position, according to one or more embodiments shown and described herein.

Referring now to FIGS. 4 and 5, a non-limiting example of a securing mechanism 58 for rotatably coupling the foot plates 38 to the side rails 14 and securing the foot plates 38 in the folded position is shown. It should be understood that the foot plates 38 may be rotatably coupled to the side rails 14 in a manner different from that illustrated by FIGS. 4 and 5. As shown in FIG. 4, the foot plates 38 are in the unfolded position and extend across at least substantially the entire width $W_M$ of the mobility device 10. In embodiments, each side rail 14 includes an inner portion 60 and a bracket 62 fixed to the inner portion 60 and extending in an inwardly direction toward an opposite side rail 14. The bracket 62 may be an L-shape having a first leg 64 and a second leg 66 extending from an end of the first leg 64. Thus, a channel 68 may be provided between the second leg 66 of the bracket 62 and the inner portion 60 of the side rail 14 for receiving a corresponding foot plate 38 when in the folded position, as described in more detail herein. In embodiments, the second leg 66 of the bracket 62 has a first locking member 70 such as, for example, a hook, clasp, or the like. The hinge 52 has a first hinge segment 72 and a second hinge segment 74, pivotally attached to one another, and hingedly couples a foot plate 38 to a corresponding bracket 62. In embodiments, the first hinge segment 72 includes a second locking member 76 such as, for example, a hook, clasp, or the like for engaging the first locking member 70 when the foot plate 38 is rotated into the folded positioned in the direction of arrow $A_2$ and lowered into the channel 68 in the direction of arrows $B_2$, as shown in FIG. 5. It should be appreciated that when the foot plate 38 is in the folded position, the foot plate 38 is positionable between an unlocked state in which the foot plate 38 is raised in the direction of arrow $B_1$ and the first locking member 70 does not engage the second locking member 76, and a locked state in which the foot plate 38 is lowered in the direction of arrow $B_2$ and the first locking member 70 engages the second locking member 76.

In embodiments, the foot plate 38 may be prohibited from being positioned in the unfolded position when the foot plate 38 is lowered into the channel 68 without the use of the first locking member 70 and the second locking member 76. Specifically, when the foot plate 38 is lowered into the channel 68, the hinge 52 may be prohibited from rotating against the second leg 66 of the bracket 62 and into the unfolded position based on a pivot point between the first hinge segment 72 and the second hinge segment 74 being below a top of the second leg 66 of the bracket 62. Lifting the hinge 52 in the direction of arrow $B_1$ allows the second hinge segment 74 to rotate in the direction of arrow $A_1$ over the top of the second leg 66 of the bracket 62 and position the foot plate 38 in the unfolded position.

As discussed herein, the foot plates 38 may be manually operated or powered to be positioned between the unfolded position and the folded position. When manually operated, a user may lift each foot plate 38 in the direction of arrows $B_1$ and rotate the foot plates 38 in the direction of arrows $A_1$ to position the foot plates 38 in the unfolded position. The first locking member 70 and the second locking member 76 may be automatically disengaged when the foot plate 38 is lifted or, in embodiments, may require manual disengagement prior to lifting the foot plate 38. Similarly, the foot plates 38 may be positioned back into the folded position by rotating the foot plates 38 in the direction of arrows $A_2$ and lowering the foot plates 38 in the direction of arrows $B_2$. Thereafter, the first locking member 70 and the second locking member 76 may automatically engage one another to lock the foot plates 38 in the folded position or, in embodiments, be manually engaged.

From the above, it is to be appreciated that defined herein is a mobility device positionable between at least a powered transport position and a powered wheelchair position, including a pair of foot plates positionable between an unfolded position and a folded position. The pair of foot plates each have a length at least substantially equal to a length of the mobility device. Providing the pair of foot plates having a length at least substantially equal to a length of the mobility device allows for cargo to be stored under a seat member of the mobility device when in the powered wheelchair position, and allows a user or cargo to be supported along a substantial length of the mobility device when in the powered transport position and the foot plates are in the unfolded position.

It is noted that the terms "substantially" and "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

While particular embodiments have been illustrated and described herein, it should be understood that various other changes and modifications may be made without departing from the scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A mobility device positionable between a powered transport position and a powered wheelchair position, the mobility device comprising:

a frame comprising:

a pair of side rails having a first end and an opposite second end, a wheel provided proximate the first end and the second end of each of the pair of side rails, a distance between each wheel on a corresponding one of the pair of side rails defining a length of the mobility device;

a pair of arms rotatably coupled to the first end of the pair of side rails; and a seat member positioned between the pair of arms; and a pair of foot plates pivotally attached to the pair of side rails, each foot plate rotatable between an unfolded position in which the foot plate is horizontal and a folded position in which the foot plate is vertical, each foot plate having a length at least substantially equal to the length of the mobility device.

2. The mobility device of claim 1, wherein the mobility device has a width defined by a distance between a wheel of one side rail of the pair of side rails and an opposite wheel of the other side rail of the pair of side rails, the pair of foot plates extending along at least a substantial portion of the width of the mobility device when in the unfolded position.

3. The mobility device of claim 1, wherein a plurality of apertures is formed in the pair of foot plates.

4. The mobility device of claim 1, wherein each foot plate is rotatably attached to a corresponding side rail, each foot plate is positionable between a locked state and an unlocked state when in the folded position, rotation of the foot plate from the folded position to the unfolded position being prohibited when in the locked state.

5. The mobility device of claim 4, wherein each side rail comprises an inner portion and a bracket defining a channel for receiving a corresponding foot plate when in the folded position.

6. The mobility device of claim 5, wherein the bracket includes a first locking member for receiving a second locking member of a corresponding foot plate, the second locking member engaging the first locking member when in the locked state to prohibit rotation of the corresponding foot plate from the folded position toward the unfolded position.

7. The mobility device of claim 6, wherein the second locking member of the foot plate engages the first locking member of a corresponding bracket as the foot plate is lowered into the channel.

8. The mobility device of claim 1, wherein the seat member is positionable in a stowed position when the mobility device is in the powered transport position, and a use position when the mobility device is in the powered wheelchair position.

9. The mobility device of claim 8, wherein the pair of foot plates extend under the seat member overlapping in a vertical direction when the seat member is in the use position.

10. The mobility device of claim 1, wherein at least one of the arms comprises a handle portion including a control member configured to position the pair of foot plates between the folded position and the unfolded position.

11. The mobility device of claim 1, further comprising at least one restraint device attachable to the pair of foot plates and configured to secure an object on an upper surface of the pair of foot plates.

12. A mobility device positionable between a powered transport position and a powered wheelchair position, the mobility device comprising:

a frame comprising:

a pair of side rails having a first end and an opposite second end, a wheel provided proximate the first end and the second end of each of the pair of side rails, a distance between each wheel on a corresponding one of the pair of side rails defining a length of the mobility device;

a pair of arms coupled to the first end of the pair of side rails; and a seat member positioned between the pair of arms; and a pair of foot plates pivotally attached to the pair of side rails, each foot plate rotatable between an unfolded position in which the foot plate is horizontal and a folded position in which the foot plate is vertical, each foot plate having a length at least substantially equal to the length of the mobility device, the length of each foot plate extending in a longitudinal direction parallel to a length of the pair of side rails, wherein the mobility device has a width defined by a distance between a wheel of one side rail of the pair of side rails and an opposite wheel of the other side rail of the pair of side rails, the pair of foot plates extend along at least a substantial portion of the width of the mobility device when in the unfolded position.

13. The mobility device of claim 12, wherein a plurality of apertures is formed in the pair of foot plates.

14. The mobility device of claim 12, wherein each foot plate is rotatably attached to a corresponding side rail, each foot plate is positionable between a locked state and an unlocked state when in the folded position, rotation of the foot plate from the folded position to the unfolded position being prohibited when in the locked state.

15. The mobility device of claim 12, wherein the seat member is positionable in a stowed position when the mobility device is in the powered transport position, and a use position when the mobility device is in the powered wheelchair position.

16. A mobility device positionable between a powered transport position and a powered wheelchair position, the mobility device comprising:

a frame comprising:

a pair of side rails having a first end and an opposite second end, a wheel provided proximate the first end and the second end of each of the pair of side rails, a distance between each wheel on a corresponding one of the pair of side rails defining a length of the mobility device;

a pair of arms coupled to the first end of the pair of side rails; and a seat member positioned between the pair of arms; and a pair of foot plates pivotally attached to the pair of side rails, each foot plate rotatable between an unfolded position in which the foot plate is horizontal and a folded position in which the foot plate is vertical, each foot plate having a length at least substantially equal to the length of the mobility device, each foot plate rotatably attached to a corresponding side rail and positionable between a locked state and an unlocked state when in the folded position, rotation of the foot plate from the folded position to the unfolded position being prohibited when in the locked state.

17. The mobility device of claim 16, wherein the mobility device has a width defined by a distance between a wheel of one side rail of the pair of side rails and an opposite wheel of the other side rail of the pair of side rails, the pair of foot plates extending along at least a substantial portion of the width of the mobility device when in the unfolded position.

18. The mobility device of claim 16, wherein a plurality of apertures is formed in the pair of foot plates.

19. The mobility device of claim 16, wherein the seat member is positionable in a stowed position when the mobility device is in the powered transport position, and a use position when the mobility device is in the powered wheelchair position.

* * * * *